US007373099B2

(12) United States Patent
Kweon

(10) Patent No.: US 7,373,099 B2
(45) Date of Patent: May 13, 2008

(54) IMAGE FORMING APPARATUS HAVING A CLEANING UNIT AND A METHOD THEREOF

(75) Inventor: Dae-seob Kweon, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 188 days.

(21) Appl. No.: 10/716,563

(22) Filed: Nov. 20, 2003

(65) Prior Publication Data

US 2005/0008403 A1 Jan. 13, 2005

(30) Foreign Application Priority Data

Jul. 9, 2003 (KR) ..... 10-2003-0046557

(51) Int. Cl.
*G03G 15/08* (2006.01)

(52) U.S. Cl. ..... 399/283

(58) Field of Classification Search ..... 399/283, 399/284, 273, 274

See application file for complete search history.

(56) References Cited

U.S. PATENT DOCUMENTS 4,733,267 A * 3/1988 Enoki et al. ..... 399/273
4,947,212 A * 8/1990 Ikegawa et al.
5,132,734 A * 7/1992 Momiyama et al.
5,182,601 A * 1/1993 Hodoshima et al.
5,190,842 A * 3/1993 Saha et al.
5,424,811 A * 6/1995 Haneda
5,570,164 A * 10/1996 Yamamoto et al. ..... 399/283
6,229,980 B1 * 5/2001 Ogawa et al. ..... 399/283
6,353,720 B1 * 3/2002 Sakai et al. ..... 399/283
6,381,434 B1 * 4/2002 Yamamoto ..... 399/283
2002/0191990 A1 * 12/2002 Hirano et al. ..... 399/284
2004/0096246 A1 * 5/2004 Bae ..... 399/283

FOREIGN PATENT DOCUMENTS

JP 59172665 A * 9/1984
JP 04246670 A * 9/1992
JP 08-146763 6/1996
JP 08146763 A * 6/1996
JP 63075778 A * 4/1998
KR 1999-831 1/1999
KR 1999-38141 10/1999

* cited by examiner

*Primary Examiner*—Susan Lee
(74) *Attorney, Agent, or Firm*—Stanzione & Kim, LLP

(57) ABSTRACT

An image forming apparatus of a contact-type to develop an electrostatic latent image using a single-component non-magnetic toner includes a photoconductive medium, a developing roller to move and attach toner to the photoconductive medium to develop the electrostatic latent image, a developing unit to support the developing roller to be rotatable, and having a toner receptacle to store the toner, a toner supplying roller to rotate in contact with the developing roller with a predetermined nip with the developing roller to supply the toner in the toner receptacle of the developing unit to the developing roller, and a cleaning unit to remove from the toner supplying roller the toner which remains on the toner supplying roller after the toner is transferred from the toner supplying roller to the developing roller. The toner supplying roller is formed in a fur brush shape where a fur, such as nylon or acryl, is attached to a cylinder of the cleaning unit, and the cleaning unit is formed as a cleaning roller to be supported by the toner receptacle to be pressingly in contact with the toner supplying roller by a predetermined pressure to form a predetermined second nip with the toner supplying roller.

23 Claims, 2 Drawing Sheets

IMAGE FORMING APPARATUS HAVING A CLEANING UNIT AND A METHOD THEREOF

CROSS-REFERENCE TO RELATED APPLICATIONS

This application claims the benefit of Korean Application No. 2003-46557, filed Jul. 9, 2003, in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus of a contact-type to develop an image using a single-component nonmagnetic toner.

2. Description of the Related Art

An example of a conventional image forming apparatus of a contact-type to develop an electrostatic latent image using a single-component nonmagnetic toner is schematically illustrated in FIG. 1.

Referring to FIG. 1, the image forming apparatus includes a photoconductive medium 1. The photoconductive medium 1 is rotatably mounted on a main body frame (not shown) of the image forming apparatus, and the electrostatic latent image is formed on a surface thereof by electrification and light exposure.

The image forming apparatus further includes a developing roller 2 which is rotatably mounted in a developing unit 3 to contact the photoconductive medium 1. The developing unit 3 includes a toner receptacle 3*a* where a toner is stored. In the developing unit 3, a toner supplying roller 4 is also rotatably mounted to supply the toner contained in the toner receptacle 3*a* to the developing roller 2.

The developing unit 3 further includes agitators 5 and 6 to agitate the toner stored in the toner receptacle 3*a*, and a toner controlling blade 7 to remove an excessive toner from the developing roller 2 to form a regularly thin film on a surface of the developing roller.

The electrostatic latent image formed on the photoconductive medium 1 is developed using the toner by the developing roller 2. The toner is supplied from the toner receptacle 3*a* to the developing roller 2 by the toner supplying roller 4, controlled by the toner controlling blade 7 to form the thin film, and then moved to the photoconductive medium 1.

The toner supplying roller 4 rotates in an opposite direction of a tangent line of the developing roller 2, that is, in a counterclockwise direction shown in FIG. 1, and supplies the toner to the developing roller 2 as described. The toner supplying roller 4 also collects a residual toner remaining on the developing roller 2 after the electrostatic latent image is developed, and a remaining electric potential of the developing roller 2 and/or the toner supplying roller 4 is reset.

The toner supplying roller 4 is usually shaped in a fur brush form. Therefore, especially in hot and damp environment, the toner is likely to be stagnant and impregnated under the toner supplying roller 4, thereby losing its fluidity due to heat and humidity.

When the toner becomes stagnant under the toner supplying roller 4, the toner is repeatedly stressed at a first nip defined between the developing roller 2 and the toner supplying roller 4, a second nip between the developing roller 2 and the toner controlling blade 7, and a third nip between the developing roller 2 and the photoconductive medium 1. Accordingly, there are problems causing deterioration of an image quality, i.e., a 'background phenomenon', since a toner electrifying capability and a toner collecting capability deteriorate, and the toner to be mixed with the toner stored in the toner receptacle 3*a* becomes harder.

Therefore, there is a need to maintain the toner electrifying capability and the toner collecting capability of the toner supplying roller 4.

SUMMARY OF THE INVENTION

The present invention has been made to overcome the above-mentioned and/or other problems. It is an aspect of the present invention to provide an image forming apparatus in which a toner electrifying capability and a toner collecting capability are maintained at an optimum level by shaking off a stagnant toner impregnated in a toner supplying roller.

Additional aspects and advantages of the invention will be set forth in part in the description which follows and, in part, will be obvious from the description, or may be learned by practice of the invention.

In order to achieve the above-described and/or other aspects of the present invention, there is provided an image forming apparatus comprising a photoconductive medium which is rotatable and formed with the electrostatic latent image thereon, a developing roller to rotate in contact with the photoconductive medium to move and attach the toner to develop the electrostatic latent image on the photoconductive medium, a developing unit frame to support the developing roller to be rotatable, and having a toner receptacle to store the toner, a toner supplying roller to rotate in contact with the developing roller to form a predetermined nip with the developing roller so that the toner in the toner receptacle is supplied to the developing roller, and a cleaning unit to remove from the toner supplying roller a residual toner which remains on a surface of the toner supplying roller after the toner is transferred from the toner supplying roller to the developing roller.

According to another aspect of the present invention, the toner supplying roller is formed in a fur brush shape in which a fur, such as nylon or acryl, is attached on a cylinder of the toner supplying roller, and the cleaning unit is formed as a cleaning roller supported by the toner receptacle to be in pressing contact with the toner supplying roller with a predetermined pressure to form the predetermined second nip with the toner supplying roller.

According to another aspect of the present invention, the fur is approximately 5~15 deniers thick and 1.0~1.5 mm long, and the cleaning roller is formed of a strong bar of a cylindrical shape.

The nip defined between the developing roller and the toner supplying roller is approximately 0.2~0.5 mm.

According to another aspect of the present invention, the image forming apparatus further comprises a toner controlling blade to form the toner supplied to the developing roller to a regularly thin film.

Accordingly, a toner electrifying capability of the toner supplying roller can be improved since the toner does not stagnate in the toner supplying roller. Therefore, the toner collecting capability is increased, and a repeating stress to the toner due to its stagnation is reduced.

According to another aspect of the present invention, a developing unit used with an image forming apparatus having a photoconductive medium includes a toner receptacle to store a toner, a developing roller to supply the toner to the photoconductive medium, a toner supplying roller to supply the toner contained in the toner receptacle to the developing roller, and a cleaning unit to remove the toner from the toner supplying roller.

According to another aspect of the present invention, an image forming apparatus includes a photoconductive medium and a developing unit comprising a toner receptacle to store a toner, a developing roller to supply the toner to the photoconductive medium, a toner supplying roller to supply to toner contained in the toner receptacle to the developing roller, and a cleaning unit to remove the toner from the toner supplying roller.

According to another aspect of the present invention, a method used with a developing unit of an image forming apparatus having a photoconductive medium includes supplying toner stored in a toner receptacle of the developing unit to a developing roller by using a toner supplying roller disposed within the developing unit, and removing residual toner remaining on the toner supplying roller with a cleaning unit after the toner supplying operation.

According to another aspect of the present invention, a method used with an image forming apparatus includes transferring toner from a toner receptacle of a developing unit to a developing roller with a toner supplying roller to develop a toner image on a photoconductive medium, and removing the toner remaining on a toner supplying roller with a cleaning unit.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
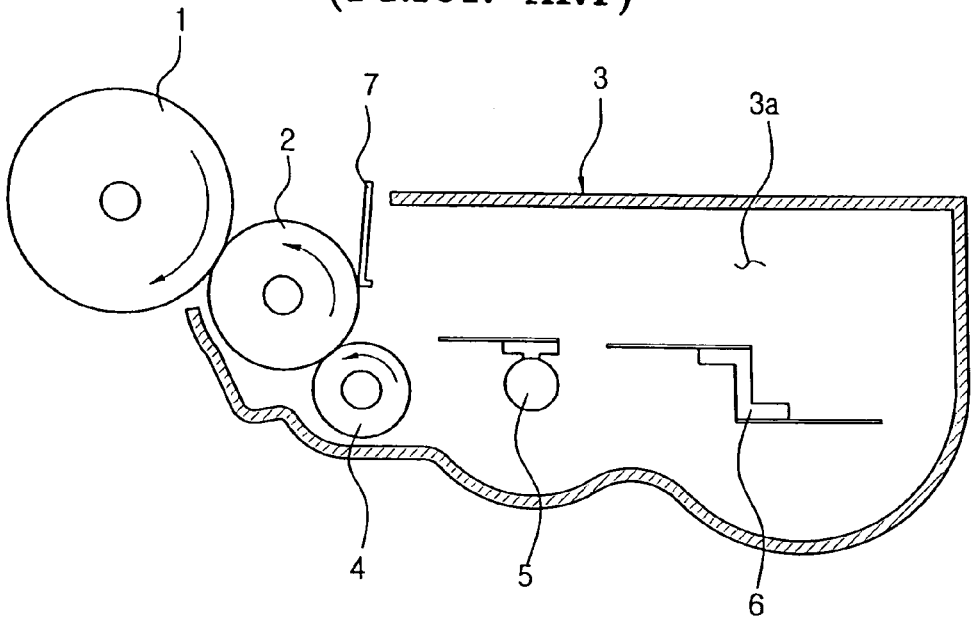
FIG. 1 (PRIOR ART)
FIG. 1 is a schematic sectional view of a conventional image forming apparatus of a contact-type to develop an electrostatic latent image using a single-component nonmagnetic toner.

Reference will now be made in detail to an embodiment of the present invention, examples of which are illustrated in the accompanying drawings, wherein like reference numerals refer to the like elements throughout. The embodiment is described below in order to explain the present invention by referring to the figures.

Figure 2:
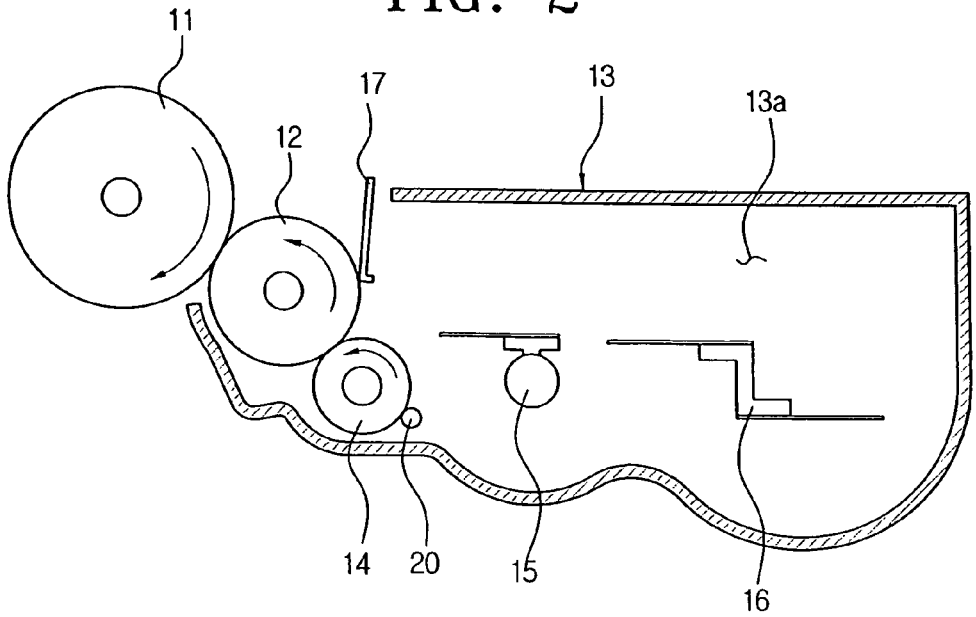
FIG. 2 is a schematic sectional view of an image forming apparatus of a contact-type to develop an electrostatic latent image using a single-component nonmagnetic toner according to an embodiment of the present invention.
Figure 3:
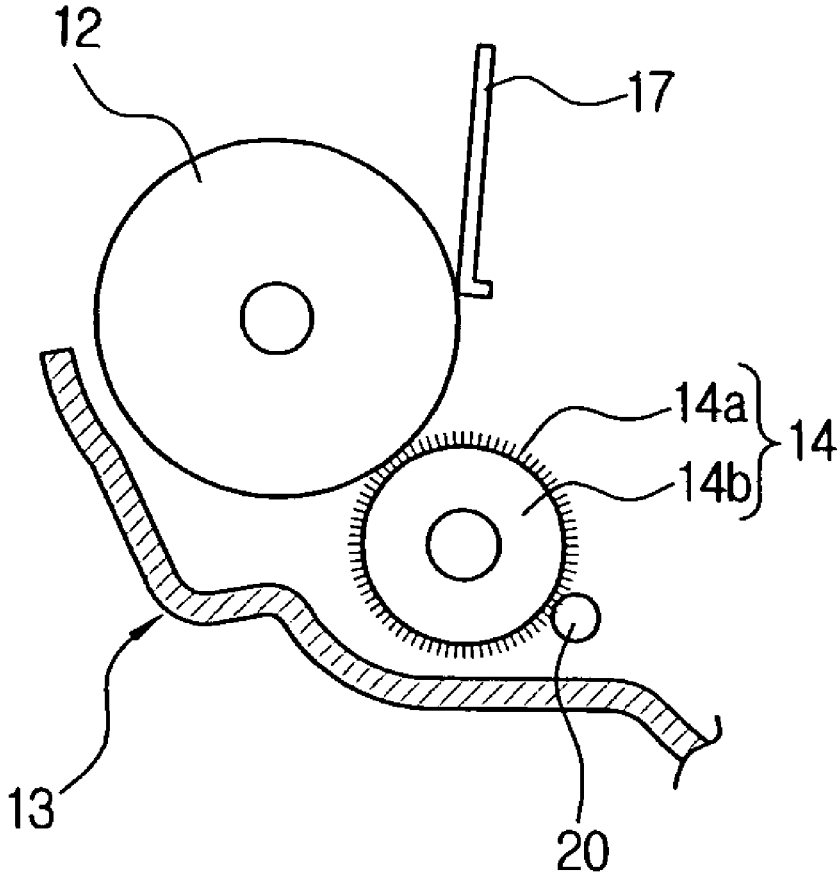
FIG. 3 is a detailed view of main elements of the image forming apparatus shown in FIG. 2.

As shown in FIGS. 2 and 3, an image forming apparatus according to an embodiment of the present invention comprises a photoconductive medium 11, a developing roller 12, a developing unit frame 13, a toner supplying roller 14 and a cleaning unit 20 to be used with the toner supplying roller 14.

The photoconductive medium 11 is rotatably mounted in a main body frame (not shown) of the image forming apparatus, and an electrostatic latent image is formed thereon by electrification and light exposure.

The developing roller 12 is rotatably mounted to be in contact with the photoconductive medium 11 in the developing unit frame 13. The developing roller 12 moves and attaches a toner, for example, a single nonmagnetic toner, supplied by the toner supplying roller 14, which will be described later, to the photoconductive medium 11 to develop the electrostatic latent image of the photoconductive medium 22 using the toner.

The developing unit frame 13 rotatably supports the developing roller 12 and includes a toner receptacle 13*a* to store the toner therein. In the toner receptacle 13*a*, agitators 15 and 16 are rotatably mounted to agitate the stored toner.

The toner supplying roller 14 is rotatably mounted in the developing unit frame 13 to be in contact with the developing roller 12 by a predetermined nip, and supplies the toner stored in the toner receptacle 13*a* to the developing roller 12. Here, the predetermined nip is approximately 0.2~0.5 mm.

The toner supplying roller 14 is formed in a fur brush shape where a fur 14*a*, such as nylon or acryl, is attached on a cylinder 14*b*. Here, the fur 41*a* is approximately 5~15 deniers thick and 1.0~1.5 mm long.

The toner stored in the toner receptacle 13*a* is moved to the developing roller 12 by the toner supplying roller 14. Then, the toner is formed into a thin film by the toner controlling blade 17 and attached to the photoconductive medium 11. As a result, the electrostatic latent image formed on the photoconductive medium 11 is developed.

In the meantime, the cleaning unit 20, which is provided according to an aspect of the present invention, removes a residual toner remaining on the toner supplying roller 14 after the toner is transferred to the developing roller 12, so that the remaining toner is prevented from being impregnated in a plurality of hairs of the fur 14*a*. The cleaning unit 20 is formed as a cleaning roller supported by the developing unit 13 to be in pressing contact with the toner supplying roller 14 with a predetermined pressure to form a predetermined second nip therebetween. Hereinafter, the cleaning unit 20 is referred to as the cleaning roller 20.

The cleaning roller 20 is preferably made by a strong bar of a cylindrical shape. However, a shape and a material of the cleaning roller 20 are not limited thereto as long as the cleaning roller 20 is able to remove the toner remaining on the toner supplying roller 14 by being in pressing contact therewith in the nip with the predetermined pressure.

In the image forming apparatus as structured above, the electrostatic latent image formed on the photoconductive medium 11 is developed using the toner by the developing roller 12. The toner is supplied from the toner receptacle 13*a* to the developing roller 12 by the toner supplying roller 14, formed into a thin toner film at the developing roller 12 by the toner controlling blade 17, and then moved to the photoconductive medium 11.

The toner supplying roller 14 rotates in an opposite direction of a tangent line with the developing roller 12, that is, a counterclockwise direction shown in FIG. 2, and supplies the toner to the developing roller 12 as described above. The toner supplying roller 14 also collects the residual toner remaining on the developing roller 12 after the electrostatic latent image has been developed, and a remaining electric potential of the developing roller 12 and/or the toner supplying roller 14 is reset.

Here, the toner supplying roller 14 would normally become in an unmovable state since the toner would normally become impregnated in the fur 14*a* for the same reason as in a conventional image forming apparatus. However, the remaining toner is removed by the cleaning roller 20 provided according to this embodiment the present invention, and accordingly, the shaken-off toner removed by the cleaning roller 20 can be fully mixed with the toner stored in the toner receptacle 13*a*.

In addition, while the conventional image forming apparatus of FIG. 1 causes deterioration of the toner electrifying capability and the toner collecting capability due to the toner remaining on -a toner supplying roller 4, the image forming apparatus according to the present invention removes the remaining toner from the toner supplying roller 14 using the cleaning roller 20. Accordingly, the toner is not impregnated in the toner supplying roller 14, thereby improving the toner electrifying capability and the toner collecting capability.

As described above, according to the present invention, the toner electrifying capability of the toner supplying roller can be improved since the toner does not stagnate on the toner supplying roller. Further, the remaining toner of the toner supplying roller is well-mixed with a new toner stored in the toner receptacle 13*a* as it is shaken off. Therefore, the toner collecting capability is increased, and repeating stress to the toner due to its stagnation is reduced.

That is, according to the present invention, since a function of the toner supplying roller does not deteriorate, an image quality can be improved, and deterioration of the image, i.e., a 'background phenomenon' is prevented.

Although an embodiment of the present invention has been shown and described, it will be appreciated by those skilled in the art that changes may be made in this embodiment without departing from the principles and spirit of the invention, the scope of which is defined in the appended claims and their equivalents.

What is claimed is:

1. An image forming apparatus having a photoconductive medium, the image forming apparatus comprising:

a developing unit to transfer a toner;

a toner supplying unit to transfer the toner to the direction of the developing unit to be formed in a fur brush shape; and a cleaning unit disposed at a position opposite to a nip with respect to a rotating axis of the toner supplying unit to remove from the toner supplying unit the toner, wherein the cleaning unit is formed as a cleaning roller to be in pressing contact with the toner supplying unit with a predetermined pressure to form a second nip with the toner supplying unit.

2. The image forming apparatus of claim 1, wherein the toner supplying unit is formed in a fur brush shape having a cylinder and a fur made of nylon or acryl and attached to the cylinder.

3. The image forming apparatus of claim 2, wherein the fur is approximately 5~15 deniers thick and approximately 1.0~1.5 mm long.

4. The image forming apparatus of claim 2, wherein the cleaning unit is formed of a strong bar of a cylindrical shape.

5. The image forming apparatus of claim 1, further comprising:

a toner controlling blade to form the toner supplied to the developing unit into a regularly thin film.

6. The image forming apparatus of claim 1, further comprising:

a developing unit frame to support the developing unit to be rotatable, and having a toner receptacle to store the toner.

7. The image forming apparatus of claim 1, wherein the developing unit is rotatably mounted in the image forming apparatus to contact the photoconductive medium.

8. The image forming apparatus of claim 1, wherein the toner supplying unit rotates in contact with the developing unit to form a predetermined nip with the developing unit.

9. The image forming apparatus of claim 1, wherein the nip defined between the developing unit and the toner supplying unit is approximately 0.2~0.5 mm.

10. The image forming apparatus of claim 1, wherein the cleaning unit is supported by a toner receptacle, which supplies the toner to the developing unit.

11. A developing unit used with an image forming apparatus having a photoconductive medium, comprising:

a toner receptacle to store a toner;

a developing unit to transfer the toner;

a toner supplying unit to transfer the toner to the direction of the developing unit, wherein the toner supplying unit is formed in a fur brush shape, wherein the toner supplying unit comprises a cylinder and a fur attached to a surface of the cylinder in a radial direction of the cylinder; and a cleaning unit is disposed to be spaced-apart from the surface of the cylinder by a predetermined distance to remove the toner from the toner supplying unit by shaking the fur of the cylinder, then cleaning unit comprising a cylindrical member having an outer surface disposed to contact the fur of the toner supplying unit.

12. The developing unit of claim 11, wherein the cleaning unit shakes off the toner remaining on a surface of the toner supplying unit.

13. The developing unit of claim 12, wherein the cleaning unit shakes a portion of the toner supplying unit.

14. The developing unit of claim 12, wherein the predetermined distance is equal to or less than length of the fur.

15. The developing unit of claim 14, wherein the outer surface of the cylindrical member is spaced-apart from the surface of the cylinder by another predetermined distance which is equal to or less than the length of the fur.

16. The developing unit of claim 14, wherein the cleaning unit is disposed to contact the fur of the toner supplying unit and shakes the fur when the toner supplying unit rotates, so that the toner attached to the fur is removed.

17. The developing unit of claim 14, wherein the cleaning unit is stationary, and the fur of the toner supplying unit contacts the cleaning unit while rotating together with the cylinder of the toner supplying unit.

18. The developing unit of claim 11, wherein the cleaning unit is disposed in a direction parallel to a rotation axis of the toner supplying unit.

19. The developing unit of claim 11, wherein the toner supplying unit comprises fur disposed around an outer circumference thereof and the cleaning unit contacts a portion of the toner supplying unit to shake the portion of the toner supplying unit when the toner supplying unit rotates with respect to the cleaning unit, so that the toner attached to the fur of the toner supplying unit is removed.

20. The developing unit of claim 11, wherein the cleaning unit pushes a portion of the toner supplying unit with respect to the developing unit.

21. The developing unit of claim 11, wherein the cleaning unit pushes the toner supplying unit with respect to the toner receptacle.

22. The developing unit of claim 11, wherein the toner supplying unit comprises a cylinder and a fur attached to the cylinder, and the cleaning unit is disposed to contact the fur of the toner supplying unit and shakes the fur of the toner supplying unit when the toner supplying unit rotates.

23. The developing unit of claim 12, wherein the cleaning unit is disposed to contact the toner remaining on a surface of the toner supplying unit.

* * * * *